US010961037B2

(12) United States Patent
Aikio

(10) Patent No.: US 10,961,037 B2
(45) Date of Patent: Mar. 30, 2021

(54) BOX FOR BAG-IN-BOX PACKAGE

(71) Applicant: NWB Finland Oy, Lahti (FI)

(72) Inventor: Veijo Aikio, Vantaa (FI)

(73) Assignee: NWB Finland Oy, Lahti (FI)

( * ) Notice: Subject to any disclaimer, the term of this patent is extended or adjusted under 35 U.S.C. 154(b) by 0 days.

(21) Appl. No.: 16/486,507

(22) PCT Filed: Feb. 13, 2018

(86) PCT No.: PCT/FI2018/050098
§ 371 (c)(1),
(2) Date: Aug. 16, 2019

(87) PCT Pub. No.: WO2018/150087
PCT Pub. Date: Aug. 23, 2018

(65) Prior Publication Data

US 2020/0231354 A1 Jul. 23, 2020

(30) Foreign Application Priority Data

Feb. 16, 2017 (FI) ..... 20175139

(51) Int. Cl.

| | |
|---|---|
| ***B65D 77/06*** | (2006.01) |
| ***B65D 21/02*** | (2006.01) |
| ***B65D 5/00*** | (2006.01) |
| ***B65D 5/42*** | (2006.01) |
| ***B65D 5/46*** | (2006.01) |

(52) U.S. Cl.
CPC ..... *B65D 77/065* (2013.01); *B65D 21/0212* (2013.01); *B65D 5/0015* (2013.01); *B65D 5/4266* (2013.01); *B65D 5/46088* (2013.01); *B65D 2231/002* (2013.01)

(58) Field of Classification Search
CPC ..... B65D 77/065; B65D 21/0212; B65D 5/0015; B65D 5/4266; B65D 2231/002
USPC ..... 229/117.3, 117.35, 112, 117.27, 915; 206/508, 509; 220/495.06, 601; 222/105
See application file for complete search history.

(56) References Cited

U.S. PATENT DOCUMENTS 6,228,011 B1 5/2001 Takemura et al.
6,536,655 B1 3/2003 Humphrey
(Continued)

FOREIGN PATENT DOCUMENTS

WO 9711891 A1 4/1997

OTHER PUBLICATIONS

Finnish Patent and Registration Office, Search Report of Finnish patent application No. 20175139, dated Sep. 13, 2017, 1 page.

*Primary Examiner* — Christopher R Demeree
(74) *Attorney, Agent, or Firm* — Berggren LLP

(57) ABSTRACT

The box (1) for forming a Bag-in-Box package comprises a rectangular bottom (2), a first end wall (3), a second, higher end wall (4), a first side wall (5), a second side wall (6) and a top (7). The box (1) is configured to be piled with a second, identical box (1) so that the tops (7) of the two boxes (1) face each other and the first side wall (5) of each box (1) is aligned with the first side wall (5) of the other box (1). At least one end wall (3, 4) of the box (1) is provided with a protrusion (13, 14), which extends up-wards from the top (7) of the box (1) and which is configured to be engaged with an end wall (3, 4) of the second box (1) and/or with an aperture (15) that is formed in the top (7) of the second box (1) for preventing mutual movement of the boxes (1).

12 Claims, 8 Drawing Sheets

(56) References Cited

U.S. PATENT DOCUMENTS

| | | | | |
|---|---|---|---|---|
| 6,648,218 | B2 * | 11/2003 | Katsuyama | G03G 15/0865 229/117.35 |
| D636,664 | S * | 4/2011 | Neufeldt | D9/431 |
| 8,033,447 | B2 * | 10/2011 | Katoh | G03G 15/0874 229/101 |
| 9,540,132 | B1 * | 1/2017 | Lee | B65D 5/10 |
| 9,617,030 | B2 * | 4/2017 | Guardiola | B65D 5/0227 |
| 2006/0191984 | A1 | 8/2006 | Hitosugi | |
| 2011/0204131 | A1 | 8/2011 | Brundage et al. | |
| 2012/0037635 | A1 | 2/2012 | Wolf et al. | |
| 2014/0374447 | A1 | 12/2014 | Coogan et al. | |
| 2016/0229580 | A1 * | 8/2016 | Guardiola | B65D 5/001 |

* cited by examiner

PRIOR ART

BOX FOR BAG-IN-BOX PACKAGE

PRIORITY

This application is a U.S. national application of the international application number PCT/FI2018/050098 filed on Feb. 13, 2018 and claiming priority of FI national application 20175139 filed on Feb. 16, 2017 the contents of all of which are incorporated herein by reference.

TECHNICAL FIELD OF THE INVENTION

The present invention relates to a box for a Bag-in-Box package in accordance with the preamble of claim 1. The invention also concerns a blanket for forming such a box and a Bag-in-Box package.

BACKGROUND OF THE INVENTION

So called Bag-in-Box (BiB) packages have become popular for example in beverage industry and among consumers. BiB packages can be used for storing wine, juice or other liquid. FIG. 1 shows a typical prior art BiB package. A BiB package comprises a box 101, which is typically made of cardboard. A bag 102 or bladder is arranged inside the box 101. The bag is typically made of a plastic or a layered material. BiB packages that are sold to consumers are typically equipped with a tap 103, which is used for dispensing the liquid stored in the package. The top of the box is often provided with a plastic handle 104 for carrying the package.

Compared to for example glass bottles, BiB packages have several advantages. The packages are light and easy to transport and carry. Because of the collapsing bag, only a limited amount of air can enter the bag when liquid is dispensed, which helps in keeping the liquid drinkable for a longer period of time.

Despite the many benefits of BiB packages, prior art packages have some drawbacks. Because of the shape of the packages and the handles 104, the packages cannot be piled stably. After filling the packages, the packages are typically transported to stores on pallets 105. Because of the difficult piling of the known BiB packages, they cannot be palletized as such, but the packages must be packed in cardboard boxes 106 before palletizing. In the example of FIG. 1, four BiB packages 101 are arranged in one cardboard box 106. The boxes 106 are piled on a pallet 105 and the pile is wrapped with a plastic foil.

The extra boxes form a significant additional material cost. In addition, extra work is needed for the packing. In the beverage industry the volumes are large, and even small cost savings are therefore important. An additional disadvantage of known BiB packages is that they are difficult to pile for display in stores.

SUMMARY OF THE INVENTION

An object of the present invention is to provide an improved box for a Bag-in-Box package. The box comprises a rectangular bottom having a first edge, a second edge opposite to the first edge, a third edge between the first edge and the second edge, and a fourth edge opposite to the third edge, a first end wall extending upwards from the first edge of the bottom, a second end wall extending upwards from the second edge of the bottom, a first side wall extending upwards from the third edge of the bottom, a second side wall extending upwards from the fourth edge of the bottom, and a top, wherein the second end wall is higher than the first end wall, and the bottom, end walls, side walls and top together define a closed space for accommodating a bag containing liquid. The characterizing features of the box according to the invention are given in the characterizing part of claim 1. Another object of the invention is to provide a blanket for such a Bag-in-Box package. Still another object of the invention is to provide an improved Bag-in-Box package.

The box according to the invention is configured to be piled with a second, identical box so that the tops of the two boxes face each other and the first side wall of each box is aligned with the first side wall of the other box, and at least one end wall of the box is provided with a protrusion, which extends upwards from the top of the box and which is configured to be engaged with an end wall of the second box and/or with an aperture that is formed in the top of the second box for preventing mutual movement of the boxes in at least one direction.

The box according to the invention can thus be used for forming piles of two boxes. The sets of two boxes can be further piled. Because of the at least one protrusion that is arranged in an end wall of the box, the relative movements of piled boxes are limited. The boxes are thus easy to pile even with robots. With boxes according to the invention, the boxes can be palletized without a need to pack them in cardboard boxes. This reduces material and packaging costs. The box can be configured to form together with the second, identical box a rectangular unit. The units of two boxes are thus easy to pile.

According to an embodiment of the invention, each of the first end wall and the second end wall is provided with a protrusion. This helps to better engage two boxes with each other.

According to an embodiment of the invention, the top of the box is provided with an aperture that is configured to be engaged with a protrusion of an end wall of a second box. A protrusion engaging with an aperture effectively prevents mutual movements of the boxes in a horizontal plane.

The aperture can be arranged adjacent to the first end wall, in which case the second end wall of the box is provided with a protrusion. By arranging the aperture at the lower end of the box, the boxes are easier to align when piled.

According to an embodiment of the invention, the width of the protrusion is substantially the same as the width of the aperture.

According to an embodiment of the invention, each side of the protrusion of the second end wall is provided with a notch, which can be engaged with the aperture of the top. The notches help to prevent mutual movements of two piled boxes even more effectively.

When two boxes are piled, the first end wall of a first box is substantially aligned with the second end wall of a second box.

According to an embodiment of the invention, the height of each side wall increases from the first end wall towards the second end wall. The height of the side walls can increase linearly.

According to an embodiment of the invention, at least part of the top of the box is inclined relative to the bottom.

According to an embodiment of the invention, the top is arranged to join to the second end wall below the upper edge of the second end wall so that when two boxes are piled against each other, two chambers are formed between the boxes, each chamber being located adjacent to the second end wall of one of the boxes and delimited by part of the second end walls, side walls and tops of the two boxes. The chambers can form protective spaces for the taps of the bags of the boxes.

The blank according to the invention is configured to form a box defined above.

The Bag-in-Box package according to the invention comprises a box defined above and a bag containing liquid.

BRIEF DESCRIPTION OF THE DRAWINGS

Embodiments of the invention are described below in more detail with reference to the accompanying drawings, in which.

DESCRIPTION OF EMBODIMENTS OF THE INVENTION

Figure 1:
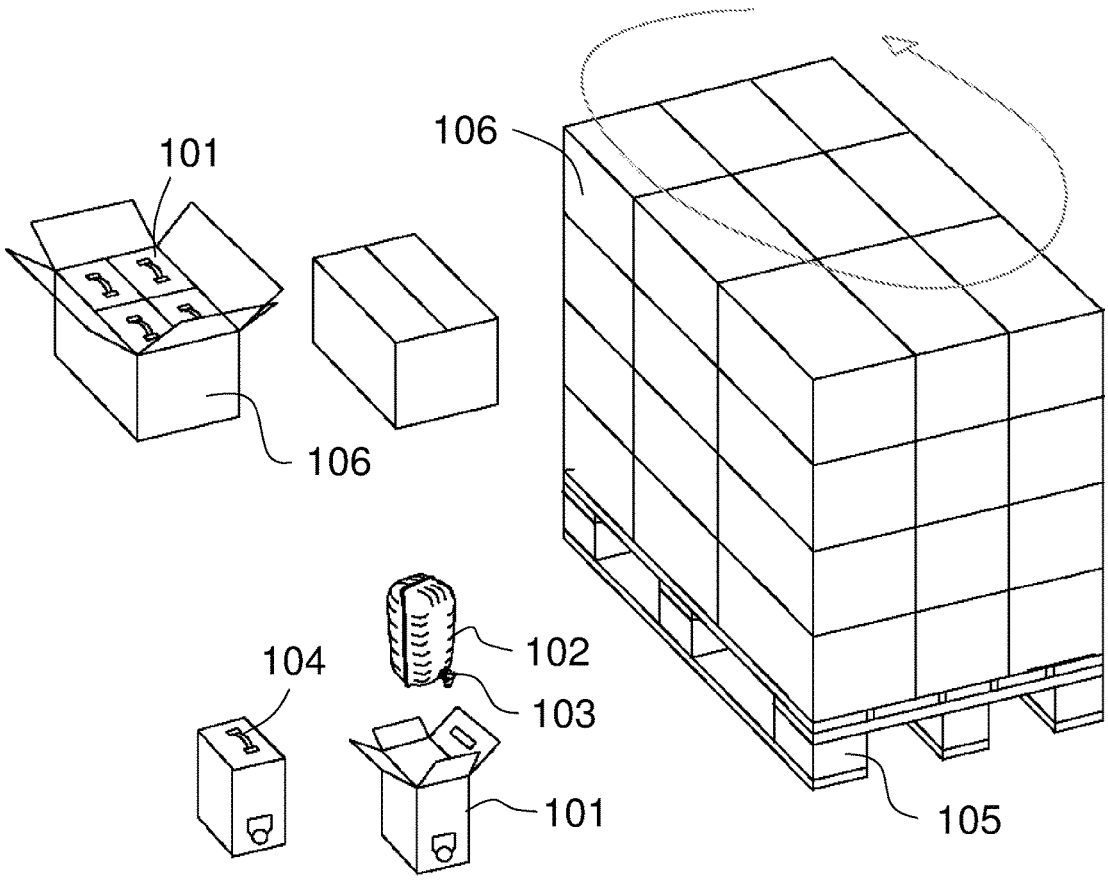
FIG. 1 shows a prior art Bag-in-Box package and a method of palletizing the packages.
Figure 2:
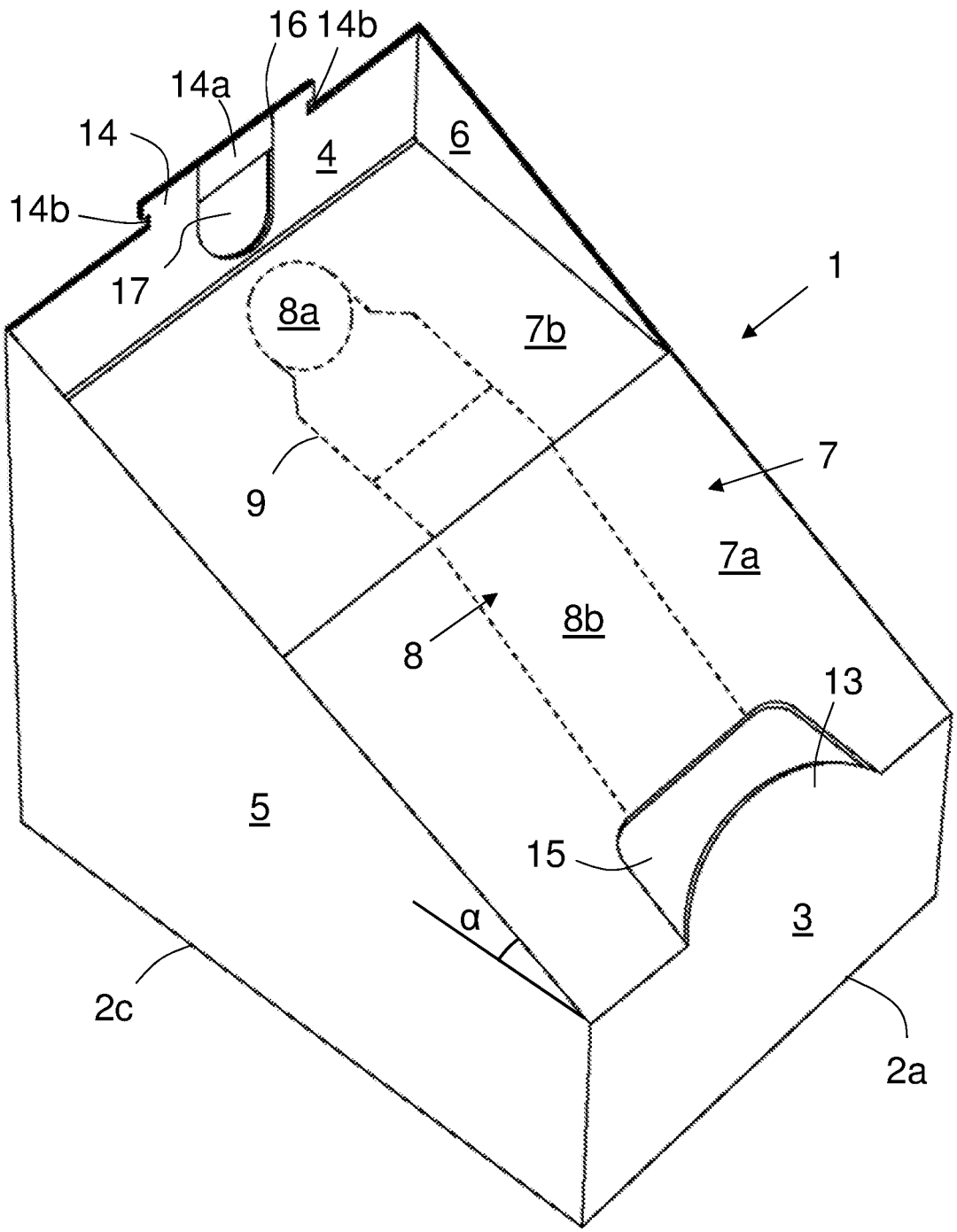
FIG. 2 shows a box according to an embodiment of the invention.
Figure 5:
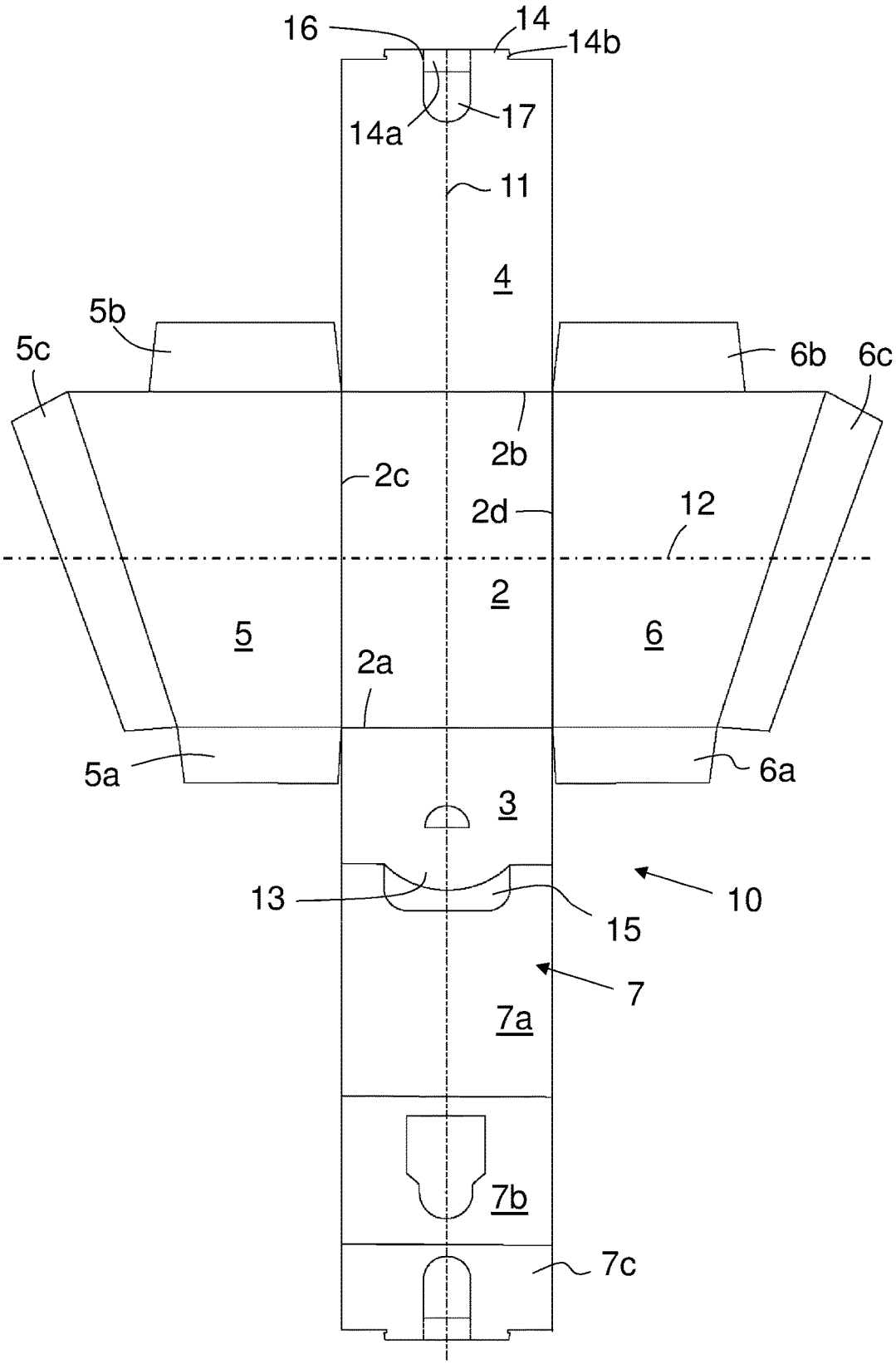
FIG. 5 shows a blanket for forming a box shown in FIGS. 2 to 4.

A box 1 according to an embodiment of the invention is now described by mainly referring to FIG. 2, which shows an assembled box 1, and to FIG. 5, which shows a blanket 10 for forming the box 1 of FIG. 1. It should be noted that the box 1 could also be formed from a different blanket. The box 1 forms part of a Bag-in-Box package. The box 1 is configured to receive a bag 18, which can be seen in FIG. 9. The bag 18 is provided with a tap 19 for dispensing liquid from the bag 18. The box 1 comprises a rectangular bottom 2 (not shown in FIG. 2), end walls 3, 4, side walls 5, 6, and a top 7. The terms "bottom", "side walls", "end walls" and similar expressions are used here to refer to a box 1 in the position of FIG. 2. It should be noted that the box 1 can be filled, stored, transported and used in different positions.

The bottom 2 of the box 1 has a first edge 2*a*, a second edge 2*b* opposite to the first edge 2*a*, a third edge 2*c* between the first edge 2*a* and the second edge 2*b*, and a fourth edge 2*d* opposite to the third edge 2*c*. In an assembled box 1, the first end wall 3 extends upwards from the first edge 2*a*, the second end wall 4 extends upwards from the second edge 2*b*, the first side wall 5 extends upwards from the third edge 2*c*, and the second side wall 6 extends upwards from the fourth edge 2*d*. Together the first end wall 3, the second end wall 4, the first side wall 5 and the second side wall 6 form a peripheral wall of the box 1. The top 7 forms a lid of the box 1. Together the bottom 2, end walls 3, 4, side walls 5, 6 and the top 7 define a closed space for accommodating a bag 18 that is used for storing liquid. The box 1 is configured so that the tap 19 of the bag 18 can be pulled out via the top 7 of the box 1. The liquid stored in the bag 18 can be an alcoholic or a non-alcoholic beverage, such as wine, juice or water. The bag 18 could also contain some other liquid. The volume of the bag 18 is preferably at least one liter, typically at least two liters.

The blanket 10 for forming the box 1 can be made of cardboard. The blanket 10 could also be made of some similar sheet material. The portion of the blanket 10 forming the first side wall 5 comprises flaps 5*a*, 5*b*, 5*c* for attaching the first side wall 5 to the end walls 3, 4 and to the top 7. Similarly, the portion forming the second side wall 6 is provided with flaps 6*a*, 6*b*, 6*c*. A first flap 5*a*, 6*a* is used for attaching the side wall 5, 6 to the first end wall 3, a second flap 5*b*, 6*b* is used for attaching the side wall 5, 6 to the second end wall 4, and a third flap 5*c*, 6*c* is used for attaching the side wall 5, 6 to the top 7. The flaps 5*a*, 5*b*, 5*c*, 6*a*, 6*b*, 6*c* are integral parts of the blanket 10. They can be attached to other parts of the box 1 for example by gluing. Also the top 7 is provided with a flap 7*c*, which can be used for fastening the top 7 to the second end wall 4. As noted above, also a different blanket 10 could be used for forming the box 1 shown in the figures. The flaps shown in FIG. 5 could thus be arranged in a different way.

The box 1 has a longitudinal center line 11 running in a direction that is from the first end wall 3 towards the second end wall 4. The box 1 has also a transverse center line 12 running in a direction that is from the first side wall 5 towards the second side wall 6. The box 1 is asymmetrical in respect of the transverse center line 12. The box 1 according to the embodiment shown in the figures is symmetrical in respect of the longitudinal center line 11. However, this is not necessary, but the two sides of the box 1 can have at least small differences, such as apertures, perforations or other structures.

The second end wall 4 is higher than the first end wall 3. The height of each side wall 5, 6 increases from the first end wall 3 towards the second end wall 4. The top 7 joins to the second end wall 4 at a different height than to the first end wall 3. At least part of the top 7 can be inclined in relation to the bottom 2. In the embodiment of the figures, the height of the side walls 5, 6 increases linearly. At each end, the height of the side wall 5, 6 corresponds to the height of the respective end wall 3, 4. The upper edges of the end walls 3, 4 and the side walls 5, 6 thus form a continuous perimeter. The upper edges of the side walls 5, 6 are at an angle $\alpha$ in relation to the bottom 2 of the box 1. The angle $\alpha$ can be in the range of 30 to 60 degrees.

The top 7 of the box 1 comprises a first portion 7*a* and a second portion 7*b*. The first portion 7*a* is arranged adjacent to the first end wall 3 and the second portion 7*b* is arranged adjacent to the second end wall 4. The first portion 7*a* is inclined in relation to the bottom 2 of the box 1. The inclination angle is the same as the inclination angle $\alpha$ of the upper edges of the side walls 5, 6. The first portion 7*a* of the top 7 is in the same plane with the upper edges of the side walls 5, 6. The second portion 7*b* of the top 7 is parallel to the bottom 2 of the box 1. The second portion 7*b* of the top 7 is thus below the upper edge of the second end wall 4. The second end wall 4 extends upwards from the second portion 7*b* of the top 7. Also part of the side walls 5, 6 extends above the second portion 7*b* of the top 7. A trough-like portion is thus formed adjacent to the second end wall 4. The trough-like portion is delimited by the second portion 7*b* of the top 7, part of the second end wall 4, part of the first side wall 5 and part of the second side wall 6. The second portion 7*b* of the top 7 does not need to be parallel with the bottom 2, but also the second portion 7*b* could be inclined relative to the bottom 2. However, the inclination angle could be smaller than the inclination angle of the side walls 5, 6 so that a trough-like portion is formed.

The top 7 comprises a removable tab 8. The top 7 is provided with a perforation 9, which allows removal of the tab 8. The tab 8 comprises a first portion 8*a*, which can be removed or bent for pulling the tap 19 of the bag 18 out of the box 1. The first portion 8*a* is arranged close to the second end wall 4. The first portion 8*a* is arranged in the area of the second portion 7*b* of the top 7. A second, larger portion 8*b* of the tab 8 can be removed for removing the bag 18 from the box 1 after the use of the Bag-in-Box package.

Figure 3:
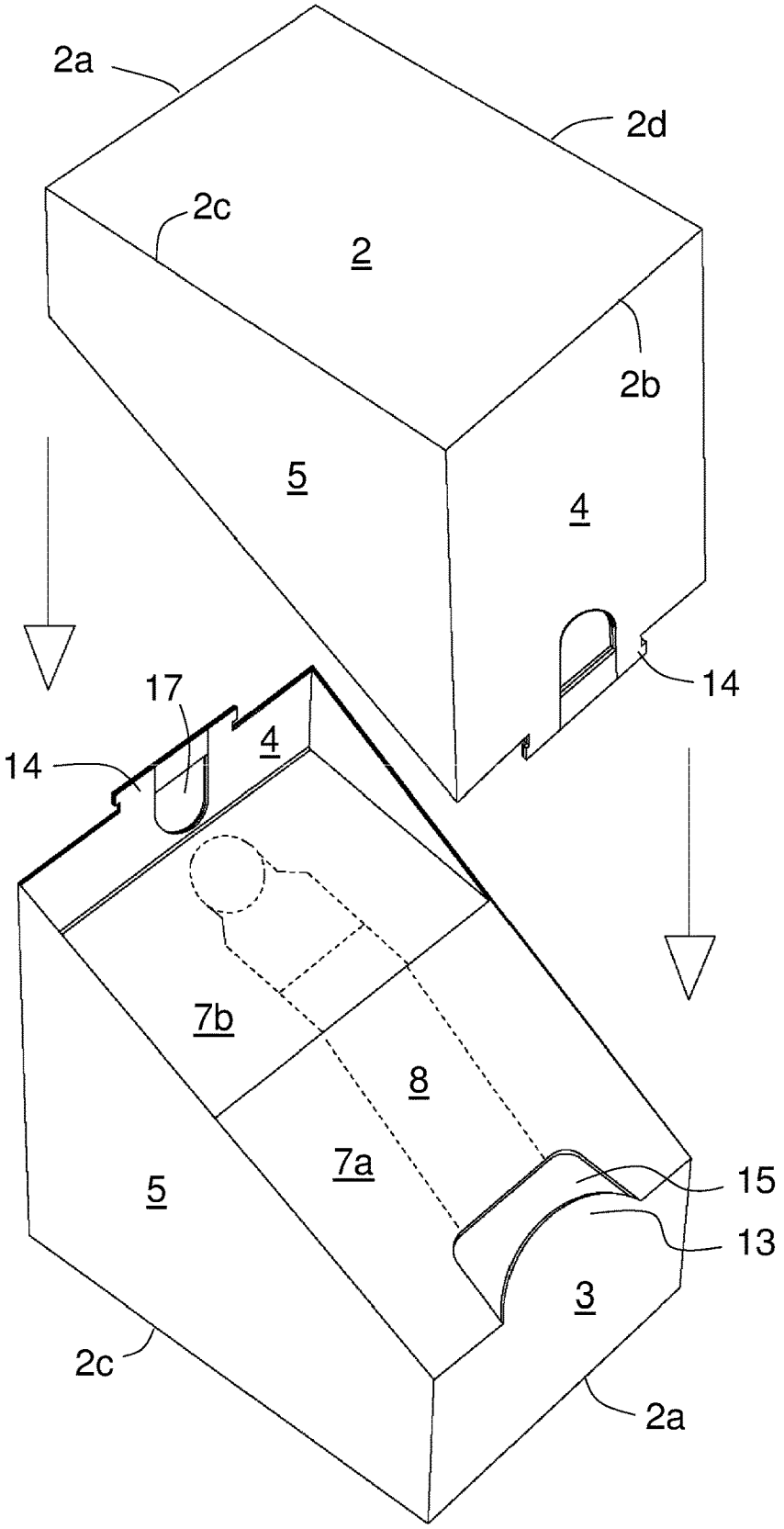
FIG. 3 shows two boxes that are aligned for piling.
Figure 4:
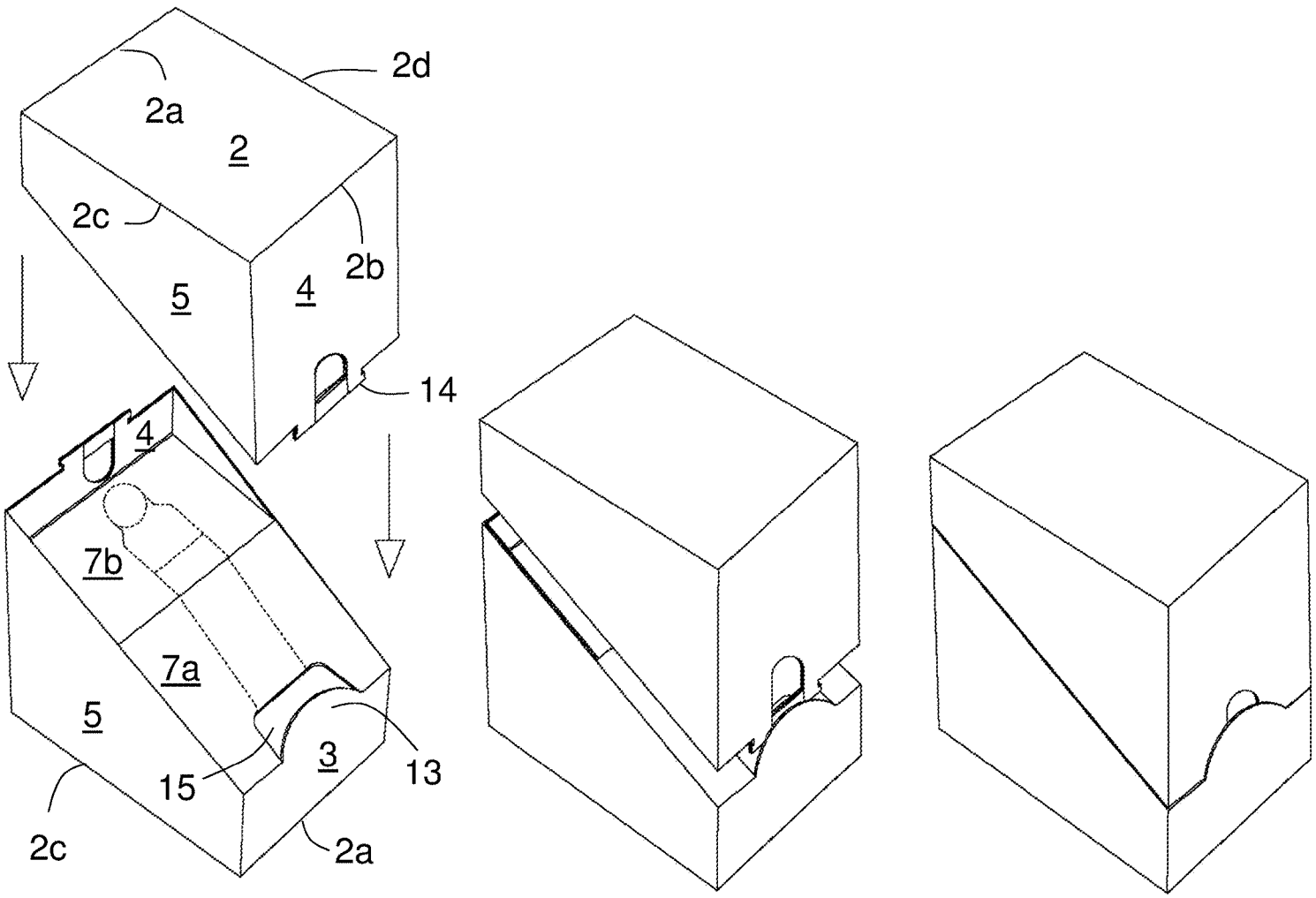
FIG. 4 shows the steps of piling two boxes.

The box 1 is configured to be piled with a second, identical box 1. Two boxes 1 are piled so that the tops 7 of the boxes 1 face each other. An upper box 1 is thus arranged upside down on top of a lower box 1. The mutual piling positions of the boxes 1 are shown in FIGS. 3 and 4. When two boxes 1 are piled, the first side wall 5 of each box 1 is aligned with the first side wall 5 of the other box 1. The first end wall 3 of each box 1 thus faces the same direction as the second end wall 4 of the other box 1. The first end wall 3 of each box 1 is substantially aligned with the second end wall 4 of the other box 1. When the two boxes 1 are piled, they form a rectangular unit. The units of two boxes 1 can thus be piled stably. Because the taps 19 are pulled out of the boxes 1 through the tops 7 of the boxes 1, in the piling positions the taps 19 are protected from dust by the closed spaces that are formed between the two boxes 1. Two boxes 1 piled against each other form two chambers, each chamber being located adjacent to the second end wall 4 of one of the boxes 1 and delimited by part of the second end walls 4, side walls 5, 6 and tops 7 of the two boxes 1.

For enabling piling of the boxes 1, at least one of the end walls 3, 4 is provided with a protrusion 13, 14. The protrusion 13, 14 is configured to engage either with an aperture of another box 1 or with an end wall 3, 4 of the other box 1. The protrusion 13, 14 extends upwards from the top 7 of the box 1. The protrusion 13, 14 also forms a raised portion of the end wall 3, 4.

In the embodiment of the figures, both the first end wall 3 and the second end wall 4 are provided with a protrusion 13, 14. The first end wall 3 is provided with a first protrusion 13. The first protrusion 13 forms an integral part of the first end wall 3 and extends in the plane of the first end wall 3 upwards from the joint of the top 7 and the first end wall 3. In the transverse direction of the box 1, the first protrusion 13 is arranged in the middle of the first end wall 3. In the example of the figures, the first protrusion 13 is semicircular. However, the first protrusion 13 could also have some other shape. The first protrusion 13 could be, for instance, rectangular. The first protrusion 13 is configured to prevent the mutual movement of two piled boxes 1 in the longitudinal direction of the boxes 1. When a second box 1 is arranged on top of a first box 1, as shown in FIG. 4, the second end wall 4 of the second box 1 is engaged with the first protrusion 13 of the first box 1. The first protrusion 13 prevents sliding of the upper box 1 in a direction that is from the second end wall 4 towards the first end wall 3. Since the upper box 1 is identical with the lower box 1, the first protrusion 13 of the upper box 1 provides the same effect.

The second end wall 4 comprises a second protrusion 14. The second protrusion 14 is arranged in the transverse direction of the box 1 in the middle of the second end wall 4. The second protrusion 14 forms an integral part of the second end wall 4. The top 7 of the box 1 is provided with an aperture 15, which is arranged adjacent to the first end wall 3. The second protrusion 14 is configured to engage with the aperture 15. The second protrusion 14 thus prevents mutual movement of two boxes 1 in the transverse direction. The second protrusion 14 also prevents mutual movement of the boxes 1 in the longitudinal direction. The protrusions 13, 14 prevent movements of piled boxes 1 in relation to each other both in the longitudinal and transverse direction. Because of the protrusions 13, 14, the boxes 1 lock together and they are easy to pile even with robots.

Each side of the second protrusion 14 is provided with a notch 14*b*. The notch 14*b* is configured to be engaged with the aperture 15 arranged in the top 7 of another box 1. Because of the notches 14*b*, the sides of the second protrusion 14 form hook-like portions, which can grip the edges of the aperture 15. The notches 14*b* effectively prevent movements of two boxes 1 relative to each other. The width of the second protrusion 14 is substantially the same as the width of the aperture 15. When two boxes 1 are piled, a transversal movement of the boxes 1 relative to each other causes that part of the second protrusion 14 of the upper box 1 is inserted below the top 7 of the lower box 1. Similarly, a notch 14*b* of the second protrusion 14 of the lower box 1 is engaged with the aperture 15 of the upper box 1. Upward movement of the upper box 1 is thus prevented.

Figure 8:
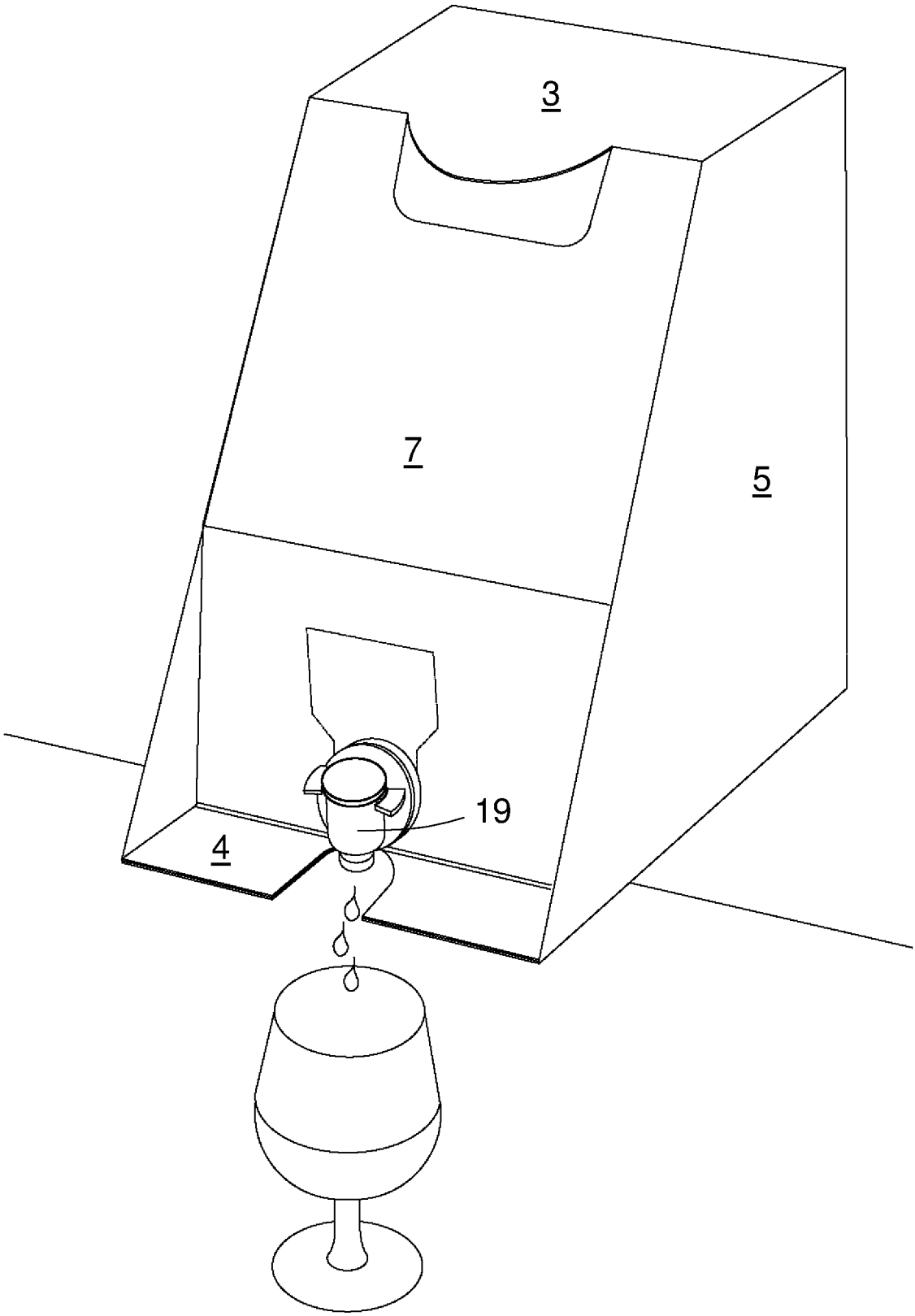
FIG. 8 shows a box according to the invention in a dispensing position.

A middle portion 14*a* of the second protrusion 14 can be removed along perforations 16. Dispensing of liquid through the tap 19 is difficult if the middle portion 14*a* of the second protrusion 14 is intact. The middle portion 14*a* thus functions as a seal showing that the package is unused. FIG. 8 shows how the middle portion 14*a* of the second protrusion 14 has been removed for allowing dispensing of liquid from the bag 18 via the tap 19.

The second end wall 4 is provided with an opening 17. The opening 17 is arranged in the transverse direction of the box 1 in the middle of the second end wall 4. The opening 17 is located below the second protrusion 14. The opening 17 facilitates carrying of the box 1.

Figure 6:
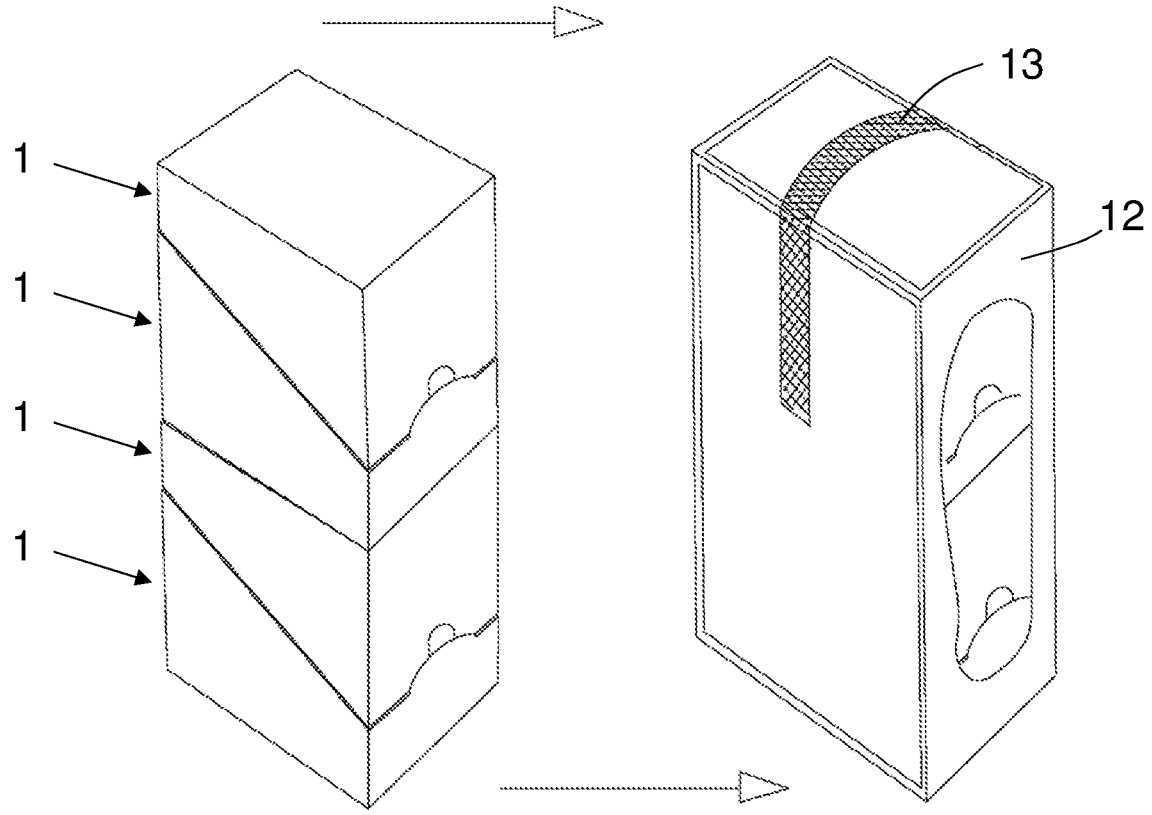
FIG. 6 shows four boxes wrapped in a plastic foil.
Figure 7:
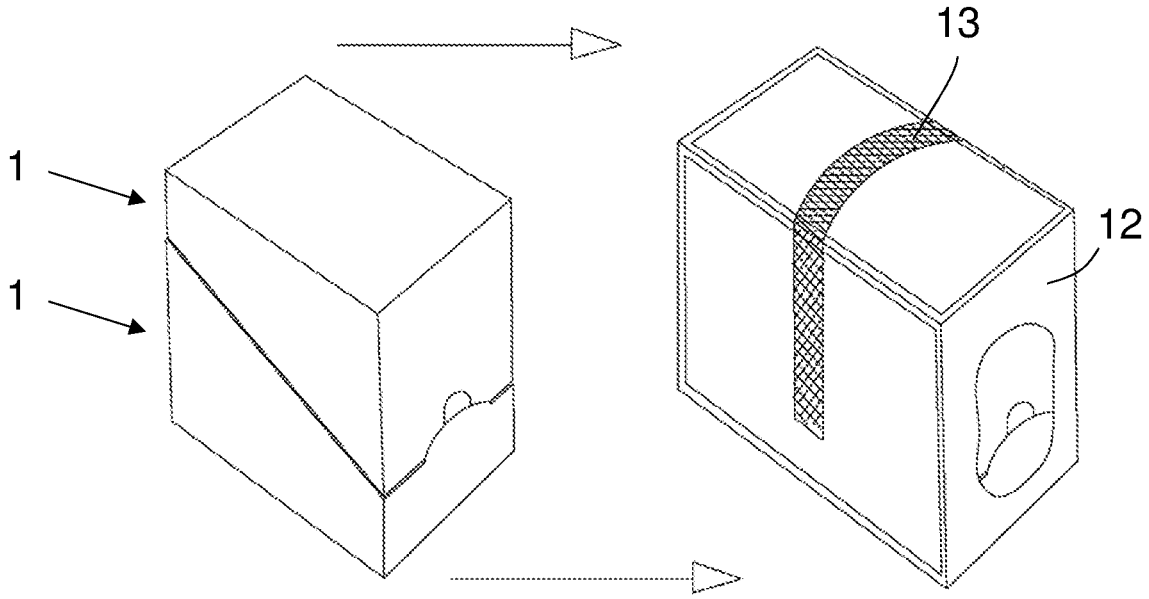
FIG. 7 shows two boxes wrapped in a plastic foil.

FIGS. 6 and 7 show two alternative ways of piling the Bag-in-Box packages for palletizing. In the embodiment of FIG. 6, four packages have been piled and wrapped in a plastic foil 12. In the embodiment of FIG. 6, the plastic foil is heat-shrinkable plastic. A handle 13 has been fastened to the wrapping around the packages. The handle 13 can be fastened, for instance, by gluing. In the embodiment of FIG. 7, a similar wrapping is used. However, the plastic foil is arranged around a set of two packages. Two sets of two boxes 1 can be wrapped in an additional plastic foil to form a four-pack. The handle 13 is made of a thin sheet material. It does thus not disturb piling of the sets of Bag-in-Box packages. The plastic foil 12 shown in FIGS. 6 and 7 replaces the cardboard boxes 106 shown in the prior art solution of FIG. 1. The sets can thus be piled on a pallet as such and wrapped in a plastic foil. The need for cardboard boxes and the process steps related to packing of the Bag-in-Box packages into the cardboard boxes are thus eliminated. The cost of the plastic foil 12 is much lower than the cost of the cardboard boxes and also the whole palletizing process is simpler. The overall packing costs are therefore reduced. Instead of wrapping the boxes 1 in a plastic foil 12 as shown in FIGS. 6 and 7, the boxes 1 could be fixed together by means of one or more bands. The bands can be, for instance, plastic bands that are tightened around two or four boxes 1.

FIG. 8 shows the Bag-in-Box package in a use position. In the use position, the second end wall 4 of the box 1 forms the bottom of the package. The tap 19 of the bag 18 has been pulled out of the box 1 by first removing the first portions 8*a* of the tab 8 that is arranged in the top 7 of the box 1. In the position shown in FIG. 8, the Bag-in-Box packages can also be piled for display in stores. In this position, the first end wall 3 of the box 1 forms an upper surface. The inclination angle $\alpha$ of the first portion 7*a* of the top 7 affects the area of the first end wall 3. The inclination angle should be selected so that the boxes 1 can be stably piled also in the position shown in FIG. 8.

Figure 9:
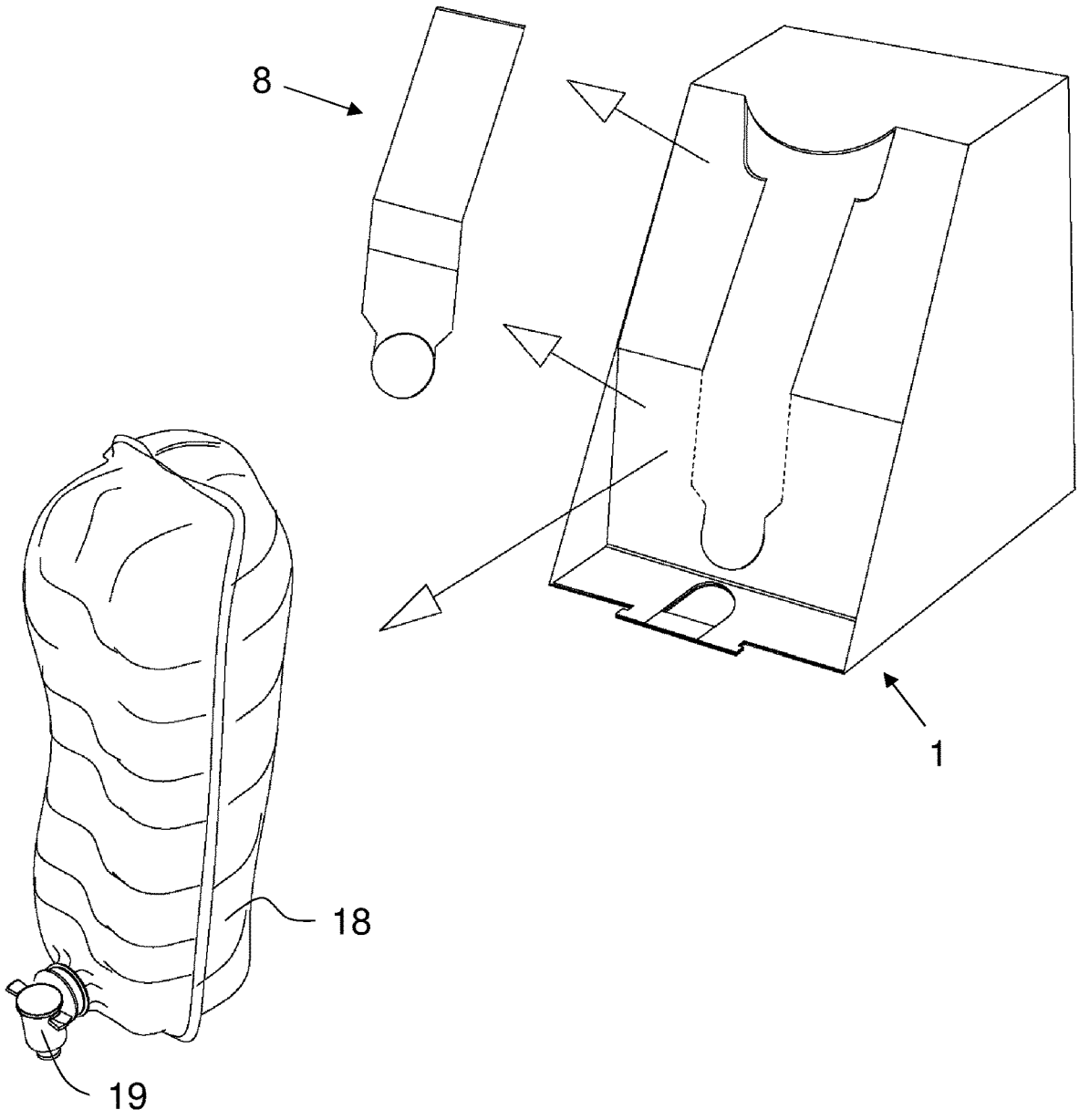
FIG. 9 shows removal of a bag from the box.

FIG. 9 shows how the Bag-in-Box package can be disposed of after use. The tab 8 can be removed from the box 1 along the perforation 9, after which the bag 18 can be removed from the box 1. The bag 18 and the box 1 can thus be recycled separately.

It will be appreciated by a person skilled in the art that the invention is not limited to the embodiments described above, but may vary within the scope of the appended claims.

The invention claimed is:

1. A box for forming a Bag-in-Box package, the box comprising:

a rectangular bottom having a first edge, a second edge opposite to the first edge, a third edge between the first edge and the second edge, and a fourth edge opposite to the third edge;

a first end wall extending upwards from the first edge of the bottom;

a second end wall extending upwards from the second edge of the bottom;

a first side wall extending upwards from the third edge of the bottom;

a second side wall extending upwards from the fourth edge of the bottom; and a top, wherein the second end wall is higher than the first end wall, and the bottom, end walls, side walls and top together define a closed space for accommodating a bag containing liquid, wherein the box is configured to be stacked with a second, identical box so that tops of the two boxes face each other and the first side wall of each box is aligned with the first side wall of the other box, and at least one end wall of the box is provided with a protrusion, which extends upwards from the top of the box and which is configured to be engaged with an end wall of the second box and/or with an aperture that is formed in the top of the second box for preventing mutual movement of the boxes in at least one direction, and wherein the top of the box is provided with an aperture that is configured to be engaged with a protrusion of an end wall of a second box.

2. The box according to claim 1, wherein each of the first end wall and the second end wall is provided with a protrusion.

3. The box according to claim 1, wherein the aperture is arranged adjacent to the first end wall and the second end wall of the box is provided with a protrusion.

4. The box according to claim 3, wherein the width of the protrusion is substantially the same as a width of the aperture.

5. The box according to claim 3, wherein each side of the protrusion of the second end wall is provided with a notch, which can be engaged with the aperture of the top.

6. The box according to claim 1, wherein the box is configured to be piled so that the first end wall of the box is substantially aligned with the second end wall of the second box.

7. The box according to claim 1, wherein a height of each side wall increases from the first end wall towards the second end wall.

8. The box according to claim 7, wherein the height of each side wall increases linearly from the first end wall towards the second end wall.

9. The box according to claim 1, wherein at least part of the top of the box is inclined relative to the bottom.

10. The box according to claim 1, wherein the top is arranged to join to the second end wall below an upper edge of the second end wall so that when two boxes are piled against each other, two chambers are formed between the boxes, each chamber being located adjacent to the second end wall of one of the boxes and delimited by part of the second end walls, side walls and tops of the two boxes.

11. A blank for forming a box for a Bag-in-Box package, wherein the blank is configured to form a box according to any of the preceding claim 1.

12. A Bag-in-Box package comprising a box and a bag containing liquid, wherein the box is formed as a box according to claim 1.

* * * * *